United States Patent [19]

Sugihara

[11] Patent Number: 4,551,113

[45] Date of Patent: Nov. 5, 1985

[54] RADIO CONTROLLED YACHT AND SAIL FOR THE LATTER

[75] Inventor: Hironobu Sugihara, Hyogo, Japan

[73] Assignee: Kabushiki Kaisha AG, Osaka, Japan

[21] Appl. No.: 555,109

[22] Filed: Nov. 25, 1983

[30] Foreign Application Priority Data

Aug. 5, 1983 [JP] Japan ..... 58-143156
Aug. 5, 1983 [JP] Japan ..... 58-122131[U]

[51] Int. Cl.[4] ..... A64H 23/04
[52] U.S. Cl. ..... 446/154; 114/144 A
[58] Field of Search ..... 446/154, 160, 163, 153, 446/454; 114/144 A, 146, 160, 161

[56] References Cited

U.S. PATENT DOCUMENTS 1,859,557 5/1932 Edgar ..... 446/154
3,280,501 10/1966 Hornbostel ..... 446/154
3,765,362 10/1973 Gitchel ..... 446/154 X
4,190,980 3/1980 Grycel ..... 446/154

FOREIGN PATENT DOCUMENTS 488822 12/1952 Canada ..... 446/163

*Primary Examiner*—Mickey Yu
*Attorney, Agent, or Firm*—Wolf, Greenfield & Sacks

[57] ABSTRACT

An improved radio controlled yacht of the type including servo motors, a battery and a receiver mounted thereon is disclosed, wherein the yacht is adapted to sail on water by itself under the influence of natural wind force while the extent of swing of its sail and the angle of turning of a rudder are controlled in response to signals transmitted from a sender. A sail servo for controlling the extent of swing of the sail includes an output shaft to which a sail trimmer is fixedly secured and sheets are inserted through holes which are formed on the end part of the sail trimmer. One end of the sheet is attached to a boom of the sail, whereas the other end of the sheet extends in the direction of the boom and it is anchored at a predetermined position located on the deck. As the sail trimmer is rotated, the end part of the sail trimmer functions in the same manner as a fall block whereby the amount of lengthening and shortening of the sail is amplified two times as much as the displacement of the end part of the sail trimmer. Thus, a small amount of rotation of the sail trimmer leads to a large amount of lengthening and shortening of the sail whereby the radio controlled yacht can be designed and constructed in smaller dimensions and with a lighter weight while it has an appearance dimensioned in an exactly reduced scale relative to a real yacht.

An improved sail for the radio controlled yacht made of a flexible film of synthetic resin is disclosed according to another aspect of the invention. In particular, the main sail has a luff which is designed in the convexly bent configuration. Design of the main sail made in that way is intended to form a loosened portion in the vicinity of the luff after a mast is inserted through the cylindrical hole on the luff. When the main sail is filled with wind, the main sail assumes a curved cross-sectional configuration similar to an aerofoil owing to the existence of the loosened portion whereby high propulsive force is generated while the main sail has an appearance very similar to that of a real yacht.

15 Claims, 31 Drawing Figures

RADIO CONTROLLED YACHT AND SAIL FOR THE LATTER

BACKGROUND OF THE INVENTION

1. Field of the Invention

The present invention relates to an improved radio controlled yacht and more particularly to improvement of or relating to a radio controlled yacht adapted to allow control of the movement of its sail and rudder with the aid of a radio control unit which is called a propo, as well as to a structure of the sail for the radio controlled yacht.

2. Description of the Prior Art

A so-called radio controlled yacht sails on water under the influence of natural wind force while the extent of movement of its sail and the angle of movement of its rudder are controlled with the aid of a radio control unit (hereinafter referred to as a propo) which essentially comprises a sender, a receiver and servos. As propos have been widely used in recent years, a variety of radio controlled models such as radio controlled boats, radio controlled aeroplanes and the like have been developed. As far as a radio controlled yacht is concerned, things are different from other radio controlled models and conventional servo cannot be employed therefor. Specifically, since a radio controlled yacht sails on water under the influence of natural wind force, the extent of movement of its sail should be adjusted properly in order to assure optimum sailing conditions. Adjustment of the extent of movement of a sail has been hitherto carried out by causing sheets attached to a boom of the sail to be extended or contracted with the aid of a servo. In view of the fact that the sail on a real yacht is ready to swing from the close hauled position where it has a limited extent of free movement to the running position where it has a relatively high freedom of movement, it is required that a radio controlled yacht has a sufficiently high extent of movement of its sail to assure that it sails on water in a manner similar to a real yacht. However, all conventional servos fail to have a sufficiently long sheet stroke and for that reason a sail servo specially designed for a radio controlled yacht has been developed which has a structure different from the conventional one.

To facilitate understanding of the invention it will be helpful that a radio controlled yacht with the conventional sail servo mounted thereon be described below by reference to FIG. 1. A radio controlled yacht 1 is constructed in the sloop style which includes a main sail 2 and a jib sail 3. The main sail 2 has a main boom 4 secured to the lower edge thereof and a main sheet 5 is attached to the one end of the main boom 4. On the other hand, the jib sail 3 has a jib boom 6 disposed therebelow and a jib sheet 9 is attached to the one end of the jib boom 6. The jib boom 6 is rotatable about a pin 8 which stands upright on the deck 7. As mentioned above, to the one end of the jib boom is attached the jib sheet 9 which extends rearward to a guide bolt 11 by way of a plurality of heatons 10. Further, after passing through the guide bolt 11, the jib sheet 9 is wound about a winding reel 13*a* of a sail servo 13 together with the main sheet 5 which has been passed through the guide bolt 12. The sail servo 13 is constructed by a combination of electronic circuits, a motor, a speed reduction gearing, pulleys and other components, said motor generating higher power than the conventional one and said speed reduction gearing being designed in a high speed reduction ratio. The sail servo 13 is operatively connected to another servo 14 therefor which is disposed in parallel to a rudder servo 15 in a spaced relation. The rudder servo 15 is operatively connected to a rudder shaft 17 via a linkage 16. The second servo 14 and the rudder servo 15 are substantially identical to one another in structure. In the drawing, reference numeral 18 designates a receiver for the propo and a power supply source 19 for the receiver 18 and another power supply source 20 for the sail servo 13 are disposed in parallel in a spaced relation at a position located away from the receiver 18. Due to the fact that the sail servo 13 consumes a large amount of electric power there is a necessity for preparing the power supply source 20 for the sail servo 13 independently of the power supply source 19 for the receiver 18.

As will be apparent from the above description, the conventional radio controlled yacht 1 is required to have three servos 13, 14 and 15, two power supply sources 19 and 20 and a single receiver 18 mounted thereon. Among these components the sail servo 13 is designed in larger dimensions with the heaviest weight and the power supply source 20 for the sail servo 13 is considerably heavy. To assure a sufficient amount of buoyancy for carrying these heavy articles the radio controlled yacht 1 is unavoidably designed with a total length of more or less 1 m and moreover it has a considerably wide breadth for the purpose of housing them within the hull. In addition to this there is a necessity to provide a large ballast attached to the bottom of the keel so as to assure that the yacht sails on water safely with the heavy articles mounted thereon. For this reason it is very difficult to fabricate a radio controlled yacht in dimensions accurately reduced in proportion to those of a real yacht in accordance with the conventional concept and therefore there has been a failure to achieve the beautiful appearance inherent to a yacht. Incidentally, a large and powerful sail winch servo has already been provided as a servo for a propo instead of the above-described combination of the sail servo 13 and the second servo 14 for the latter but this sail winch servo is also designed in larger dimensions, and is heavy in weight, and therefore it has not been possible for a radio controlled yacht to be fabricated in smaller dimensions.

As the same time, a sail to be mounted on the conventional radio controlled yacht is unavoidably designed in larger dimensions corresponding to the dimensions of the hull of the yacht. Since the conventional sail is usually produced by sewing fabric material, it has a considerable weight. As such a sail is produced in larger dimensions, the wind pressure exerted thereon increases correspondingly and its weight increases too. For this reason it is impossible to carry out proper control operations for the sail unless a specially designed sail servo is mounted on the hull. Thus, to allow a radio controlled yacht to be designed and fabricated in smaller dimensions with a lighter weight, it is essentially necessary to develop a yacht sail having small dimensions and light weight which can be controlled with the aid of a servo motor constructed in the same manner as the conventional rudder servo.

Hence, the present invention has been made with the foregoing problems in mind and its object resides in providing a radio controlled yacht and a sail for the same which are entirely free from these drawbacks.

Specifically, it is an object of the present invention to provide an improved radio controlled yacht which is designed and fabricated in dimensions reduced exactly in proportion to those of a real yacht and which has smaller dimensions and a lighter weight than those of the conventional one.

It is another object of the present invention to provide an improved sail for the radio controlled yacht as described above which is designed and easily fabricated in smaller dimensions with a lighter weight than the conventional sail while having an appearance very similar to that of a real yacht and which can generate a higher propulsive force under the influence of natural wind force when it is filled with wind.

Other objects, features and advantages of the present invention will become more clearly apparent from a reading of the following which has been prepared in connection with the accompanying drawings.

SUMMARY OF THE INVENTION

To accomplish the above object there is proposed in accordance with one aspect of the present invention an improved radio controlled yacht which is constructed as follows.

Specifically, it includes a single power supply source for a so-called propo, a single sail servo, a single receiver and a single rudder servo each of which is mounted on the hull. Said sail servo employs a servo motor for the conventional propo which is constructed in a substantially similar manner to that of said rudder servo. Accordingly, there is no necessity for employing a specially designed servo motor such as a sail winch servo or the like as a sail servo and any servo motor as used for conventional propos and which has been widely used as a rudder servo is usable. The sail servo includes an output shaft to which a sail trimmer is fixedly secured and a sheet insert hole is formed on each of the end parts of the sail trimmer. The one end of each sheet is attached to the main boom of a main sail and the jib boom of a jib sail. One of the sheets is colled the main sheet, while the other is called the jib sheet. The sheets pass through the sheet insert holes on the sail trimmer and the other end of the each sheet is extended in the direction of drawing of the latter so that it is anchored at a predetermined position on the deck of the yacht.

When the sail trimmer is rotationally actuated in operative association with the sail servo mounted on the radio controlled yacht as constructed in the above-described manner, the sheets are extended or drawn in (shortened) while passing through the sheet insert holes on the sail trimmer. As the sheets are extended, a sail swings outward to a relatively large angle under the influence of natural wind force developed when it is filled with wind, whereas as when the sheets are drawn in, the angle at which the sail is held is caused to decrease. During extension and drawing in of the sheets the sheet insert holes function for them in the same manner as a conventional fall block. In accordance with the principle of operation of the fall block the sheets are caused to lengthen or shorten by a distance two times as long as the distance of angular displacement of the sheet insert holes. This leads to an effect that a small degree of swinging movement of the sail trimmer causes the sheets to lengthen or shorten by a relatively large amount. Further, in accordance with the principle of operation of the fall block, the pulling force active on the sheets is reduced to a half of torque of the sail trimmer but, due to the fact that the sail is designed in smaller dimensions in proportion to the reduced dimensions of the radio controlled yacht itself, a backward swinging movement of the sail can be satisfactorily carried out with the aid of the sail trimmer as described above.

Since the radio controlled yacht of the invention includes a control unit which essentially comprises a single receiver, a single sail servo, a single rudder servo and a single power supply source each of which is mounted on the hull, and since any servo motor usable for a conventional propo is usable for both the sail servo and the rudder servo, it is assured that the number of articles mounted on the hull is substantially reduced and at the same time they are designed and fabricated in smaller dimensions with lighter weight. As a result it becomes possible to determine dimensions for the radio controlled yacht reduced exactly in proportion to those of a real yacht and thereby to provide an improved radio controlled yacht in smaller dimensions with lighter weight than those of the conventional one.

Further, to accomplish this second object there is proposed in accordance with another aspect of the present invention an improved sail which is preferably to be employed for the radio controlled yacht as constructed in the above-described manner, which sail is constructed as follows.

Specifically, it comprises a sail body integrally made of a flexible film of synthetic resin such as high density polyethylene or the like material, said sail body having a luff which is designed in a convexly curved configuration. It is preferable that the top of the curved portion of the luff is determined at a height equivalent to about one third of the length of the luff as measured from the tack of the sail body. A non-adhesive area linearly extending in the longitudinal direction of an adhesive tape is formed by sticking a synthetic resin tapè onto the central part of the adhesive tape. The one surface of the luff is adhesively stuck to the adhesive surface of the adhesive tape located along the one side edge thereof without any clearance kept therebetween. Next, the adhesive tape is formed into a cylindrical configuration with the non-adhesive area located inside the cylindrical configuration until the adhesive surface of the adhesive tape located along the other side edge thereof is adhesively stuck to the other surface of the luff.

Since the sail of the invention for a radio controlled yacht comprises a sail body made of flexible film of synthetic resin, it is very light in weight. Further, it is very easy to be produced merely by way of the steps of cutting synthetic resin film to a predetermined configuration and then forming a mast insert portion along the luff.

Generally, a sail for a yacht is designed and fabricated such that it has a curved cross-sectional configuration similar to that of an aerofoil when it is filled with wind so that high propulsive force is generated. The deepest part of the curved configuration of a sail is called the belly or pocket and the curved part extending to this belly is usually such that it measures about one third of the length of the sail as measured from the mast. The residual part of the sail extends in the form of a curved surface very close to a flat plane. Since the sail of the invention for a radio controlled yacht is constructed such that a luff on the sail body has a convexly curved configuration and an adhesive tape is stuck to the luff along the one side edge thereof, tension force appears at both the upper and lower end parts of the luff and compression force appears around the top of the convexly curved portion when a mast is inserted through a cylindrical hole formed along the luff. Owing to this, a loosened portion is developed at the area extending from the mast to the belly and it assumes a curved cross-sectional configuration when the sail is filled with wind whereby high propulsive force is generated. Since it is considered that compression force active on the luff of the sail reaches the maximum at the top of the convexly curved portion, it is preferable that the top of the convexly curved portion of the luff is determined at a height equivalent to about one third of the length of the luff as measured from the tack in order to assure that the deepest belly appears around the center of the area where pressure is exerted on the sail (the center of the figure of the sail).

BRIEF DESCRIPTION OF THE DRAWINGS

The accompanying drawings will be briefly described below.

DETAILED DESCRIPTION OF THE PREFERRED EMBODIMENTS

Figure 1:
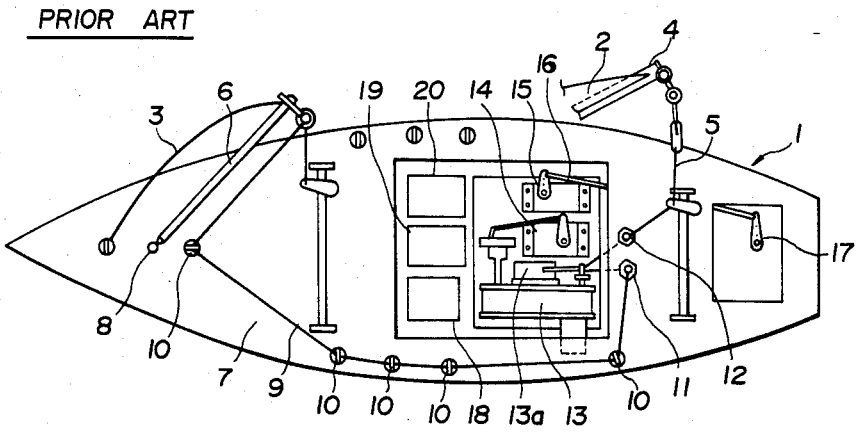
FIG. 1 PRIOR ART
FIG. 1 is a plan view of a conventional radio controlled yacht.
Figure 2:
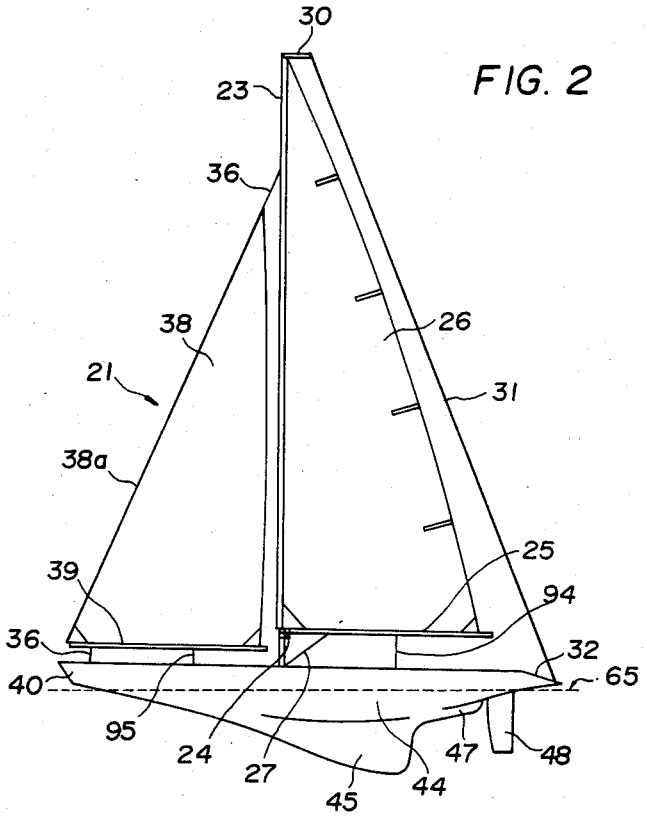
FIG. 2 is a side view of a radio controlled yacht in accordance with an embodiment of the invention.

Now, the present invention will be described in greater detail hereunder with reference to FIGS. 2 to 31 which illustrate preferred embodiments of the invention.

Description will be first made as to a radio controlled yacht of a design similar to the America's Cup style 12 meter class which is illustrated in FIGS. 2 to 19.

A radio controlled yacht as generally designated by reference numeral 21 (hereinafter referred to simply as a yacht) is designed and fabricated to a reduced scale of one fourty third relative to a real 12 meter class yacht. The yacht 21 includes a mast 23 standing upright about the central part of a deck 22, said mast 23 having a main boom 25 pivotably fitted to the lower part thereof by means of a gooseneck and bracket 24. A main sail 26 is extended between the mast 26 and the main boom 25 under the influence of tension force generated downwardly with the aid of a boom bang 27. As is apparent from FIG. 4, the boom bang 27 extends through an eye 28 fixedly secured to the lower part of the mast 23 to reach a sheet stopper 29 made of electric conductive material which projects above the deck 22 so that it is stretched from said sheet stopper 29. Further, the mast 23 includes a mast top eye 30 at the top end thereof and a backstay 31 is connected to the mast top fitting 30. The backstay 31 extends through an eye 33 disposed at the stern 32 of the yacht to be fixed to the sheet stopper 29. Reference numeral 34 designates a receiver antenna inserted through the mast 23.

The mast 23 has an eye 35 secured to the upper part thereof and a snap 37 for a forestay 36 which is engaged to said eye 35. The forestay 36 extends through a luff $38_a$ of a jib sail 38 and it is then inserted into a jib boom 39. Further, it comes out of the jib boom 39 at a position located midway along the jib boom 39 to extend through an eye 41 disposed at the bow 40 of the yacht. Further, the forestay 36 is stretched by means of another sheet stopper 42 made of electric conductive material which is disposed by the side of the aforesaid sheet stopper 29. Incidentally, in the drawing reference numeral 43 designates an adhesive tape for assuring that the main sail 26 is fixedly secured to the main boom 25 and that the jib sail 38 is fixedly secured to the jib boom 39.

A hull 44 constituting the radio controlled yacht 21 is integrally molded in accordance with the conventional injection molding process in such a manner as to include a keel 45 on the central part of the bottom thereof. A piece of ballast 46 is fixedly housed in the interior of the keel 45. Specifically, fixing of the ballast 46 is achieved by using a certain adhesive agent. A rudder 48 is disposed behind the skeg 47 of the hull 44. The rudder 48 is fixed to a rudder shaft 49 which extends through the support hole 50 on the hull 44 so as to be rotatably supported. The rudder shaft 49 includes a rudder horn 51 at its uppermost end part which is fixed thereto by means of a setscrew 52 and the upper extension of the rudder shaft 49 projected above the rudder horn 51 is capped with a short rubber tubing 53. The rubber tubing 53 is intended to prevent the rudder 48 from being disconnected from the hull 44 even when the setscrew 52 becomes loosened for some reason.

Figure 10:
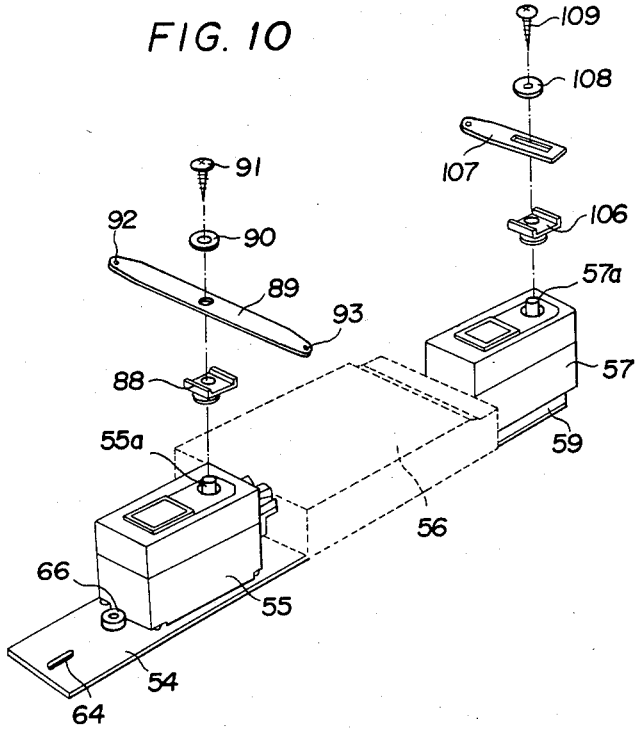
FIG. 10 is a perspective view of the control unit in FIG. 8, shown in the disassembled state.
Figure 11:
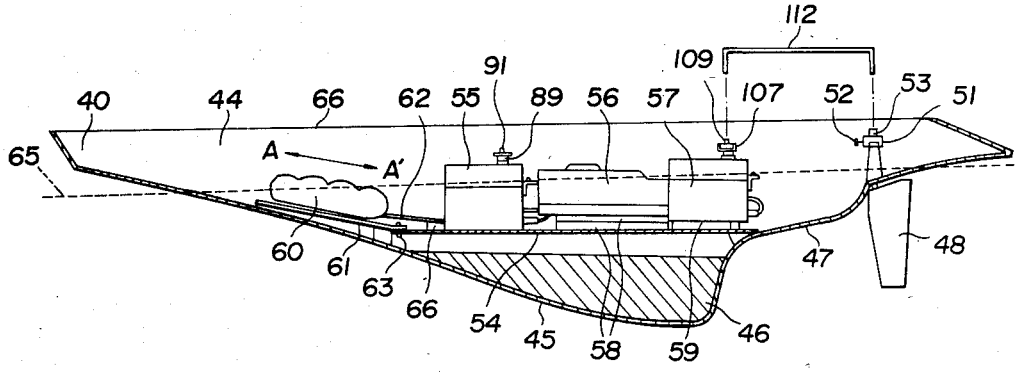
FIG. 11 is a vertical sectional view of the hull constituting the radio controlled yacht in accordance with the embodiment of the invention.
Figure 12:
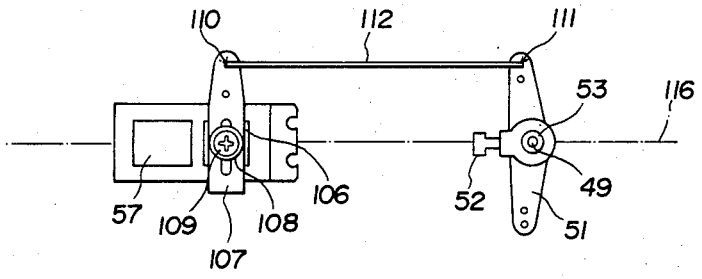
FIG. 12 is a plan view illustrating an example of an operative combination of the rudder servo and the rudder horn for the radio controlled yacht in accordance with the embodiment of the invention.
Figure 13:
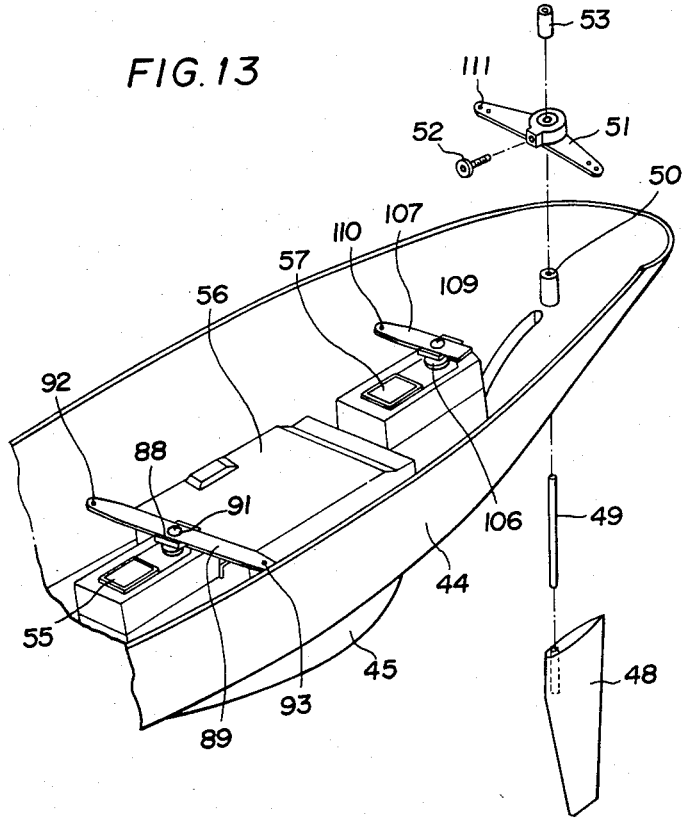
FIG. 13 is a fragmented perspective view of the rear part of the hull constituting the radio controlled yacht in accordance with the embodiment of the invention, shown in the partially disassembled state.
Figure 14:
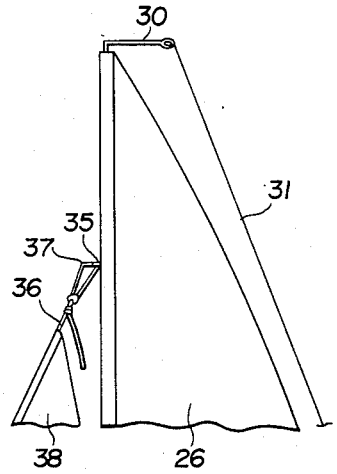
FIG. 14 is a fragmented side view of a mast top portion for the radio controlled yacht in accordance with the embodiment of the invention, drawn to an enlarged scale.
Figure 15:
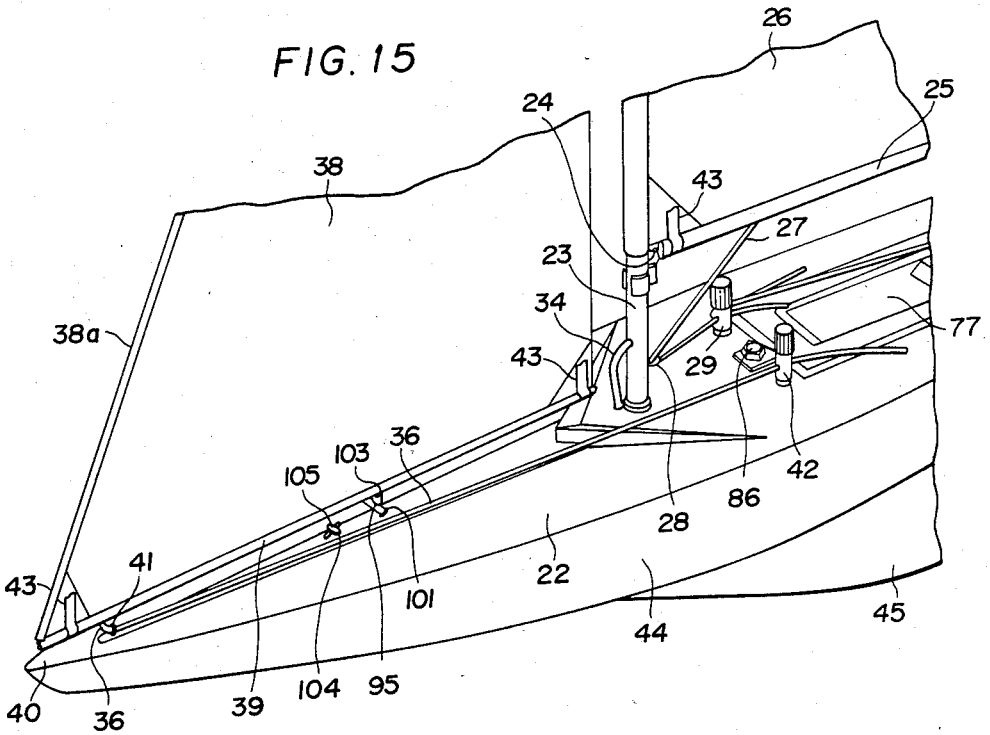
FIG. 15 is a fragmented perspective view of the fore part of the radio controlled yacht in accordance with the embodiment of the invention, drawn to an enlarged scale.
Figure 16:
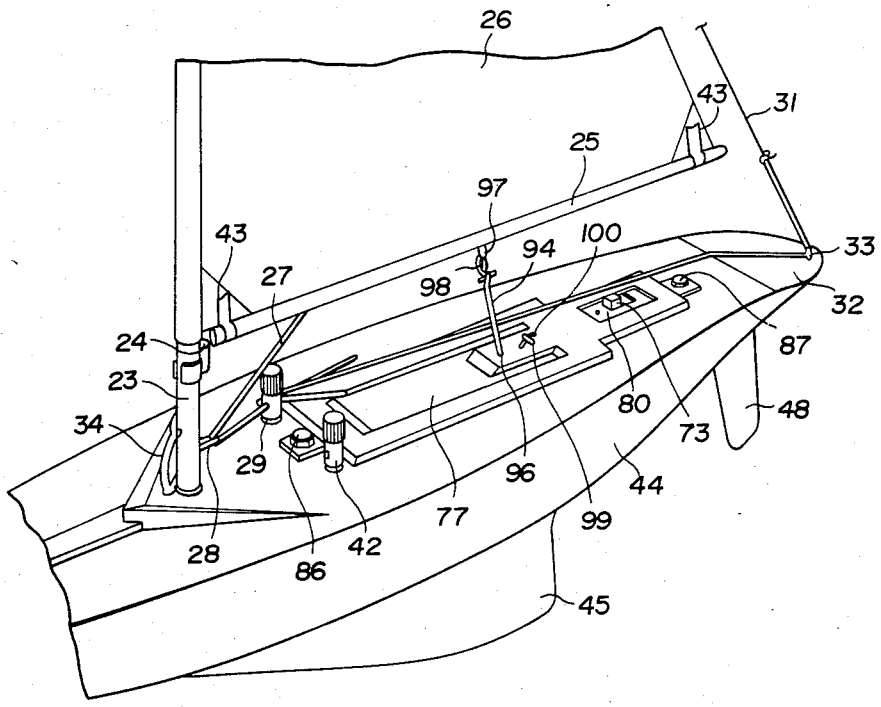
FIG. 16 is a fragemented perspective view of the rear part of the radio controlled yacht in accordance with the embodiment of the invention.
Figure 17:
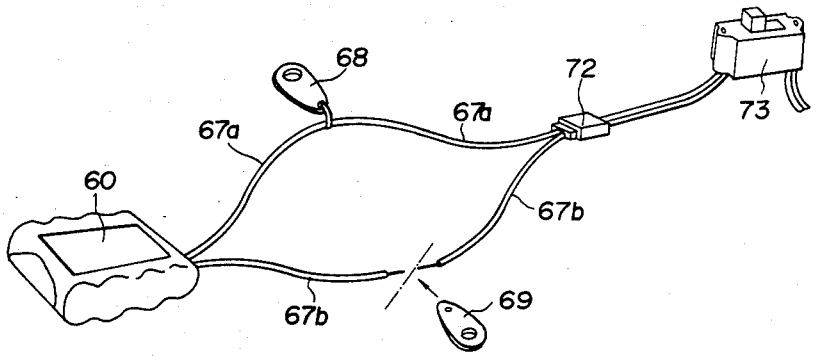
FIG. 17 is a perspective view illustrating an example of a wiring system for a rechargeable type battery mounted on the radio controlled yacht of the invention, drawn to an enlarged scale.
Figure 18:
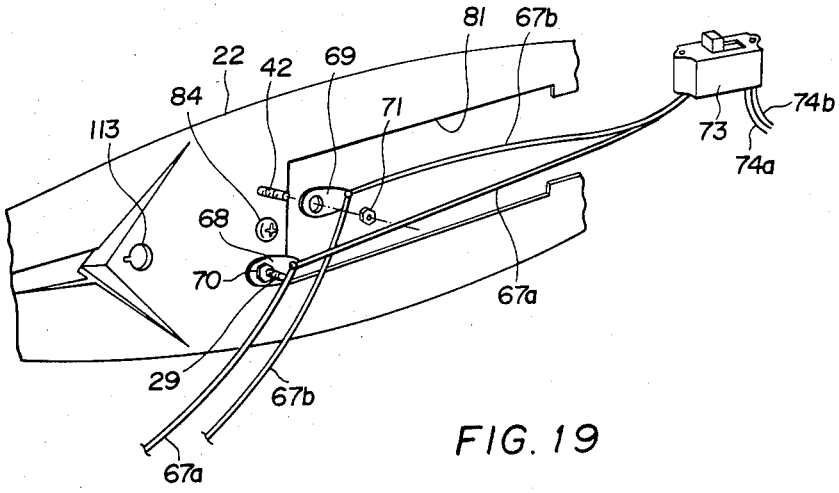
FIG. 18 is a fragmented perspective view illustrating how a pair of charging terminals are fixed to the bottom side of the deck for the radio controlled yacht in accordance with the embodiment of the invention, shown in the partially disassembled state.
Figure 19:
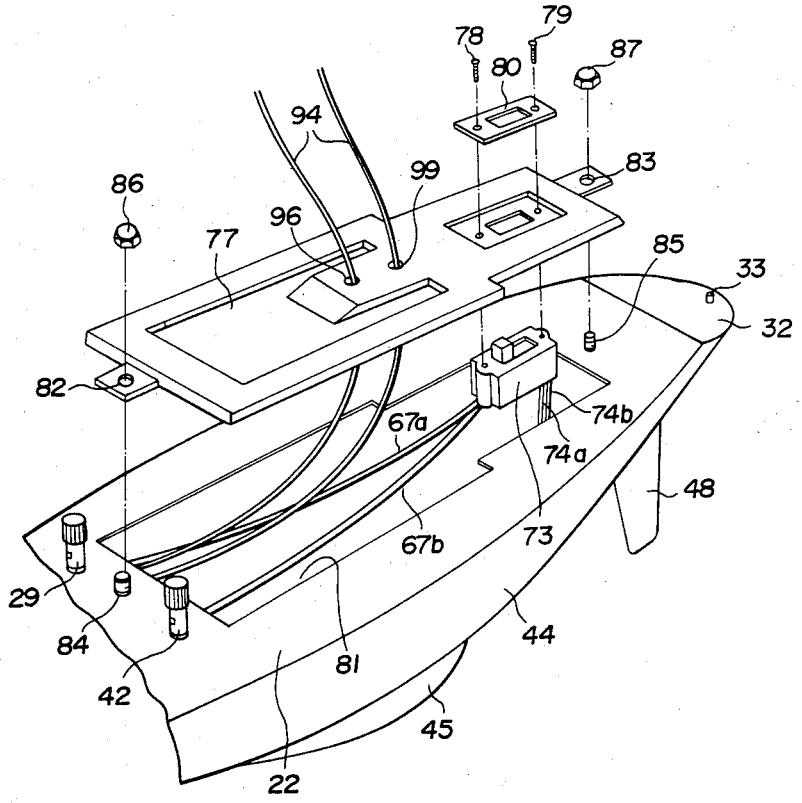
FIG. 19 is a fragmented perspective view of the rear part of the hull constituting the radio controlled yacht in accordance with the embodiment of the invention, drawn in the partially disassembled state.
Figure 20:
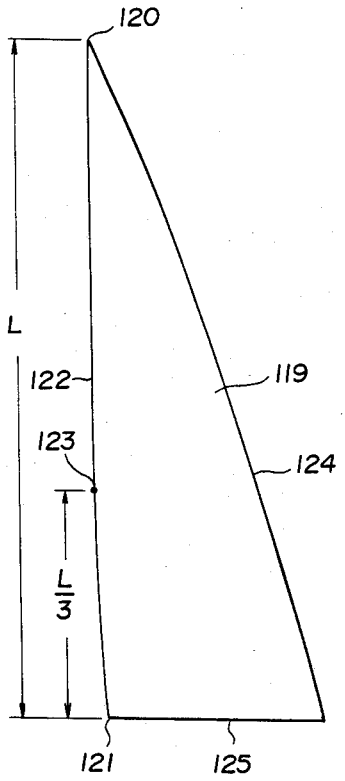
FIG. 20 is a plan view of a main sail body for the radio controlled yacht of the invention.

The hull 44 includes a R/C mount 54 detachably secured to the inner wall of the hull 44 by means of set-screws (not shown) so that a sail servo 55, a receiver 56 and a rudder servo 57 can be mounted on said R/C mount 54. The sail servo 55, the receiver 56 and the rudder servo 57 are arranged one after another in the longitudinal direction of the yacht so that the hull 44 can be designed without any unnecessary increase in width. Further, both the sail servo 55 and the rudder servo 57 are constructed substantially in the same manner and a conventional servo motor as widely used for a so-called propo is employable for them. Reference numerals 58 and 59 designate in both cases a spacer which is used for the purpose of adjusting the relative height of each of the sail servo 55, the receiver 56 and the rudder servo 57 so that the wiring operation for making electrical connection therebetween may be easily performed. Particularly, the spacer 59 serves to facilitate connection of the rudder servo 57 to the rudder horn 51 in such a manner as described later. It should be noted that the spacers 58 and 59 are not always required to be used. Next, a rechargeable type battery 60 is firmly mounted on a battery mount 61 which is in turn attached to the foremost end part of the R/C mount 54 by means of a setscrew 62 and a nut 63. Since an arrangement is made such that the setscrew 62 is inserted through an elongated hole 64 which is formed on the R/C mount 54 as illustrated in FIG. 10, the rechargeable type battery 60 can be located at any required position by unscrewing the setscrew 62 and then displacing the battery mount 61 in the direction as identified on the drawing by arrow makrs A and A' (see FIG. 11). By properly locating the battery 60 at a certain position it is assured that a water line 65 is determined correctly in the horizontal direction at a predetermined position. Generally, the water line 65 does not extend in parallel to a sheer line 66 but it extends horizontally in such a manner that the bow 40 is appreciably raised up. Instead of provision of the elongated hole 64 as described above, another arrangement may be made such that the rechargeable battery 60 is displaced forward or backward relative to the battery mount 61. Incidentally, in the drawing reference numeral 66 designates a mast step projected above the R/C mount 54.

The rechargeable type battery 60 has cords $67_a$ and $67_b$ and a pair of charging terminals 68 and 69 are fixedly secured to said cords $67_a$ and $67_b$ at a position located midway between the latter by a soldering operation. The one charging terminal 68 is fixed to the sheet stopper 29 by means of a nut 70, while the other charging terminal 69 is fixed to the sheet stopper 42 by means of a nut 71. Further, the cords $67_a$ and $67_b$ are electrically connected to a switch 73 via a connector 72. It should be noted that the connector 72 is not always required to be in use (see FIG. 18). Next, the switch 73 is electrically connected to the receiver 56 via cords $74_a$ and $74_b$ and the receiver 56 is in turn electrically connected to the sail servo 55 via cords $75_a$, $75_b$ and $75_c$. On the other hand, the rudder servo 57 is electrically connected to the receiver 56 via cords $76_a$, $76_b$ and $76_c$. The switch 73 is secured to the bottom surface of a cockpit cover 77 by means of setscrews 78 and 79 and at the same time a switch panel 80 is attached to the upper surface of the cockpit cover 77. The cockpit cover 77 is configured so as to completely cover the opening 81 on the deck 22. The cockpit cover 77 is formed with setscrew insert holes 82 and 83 at both the foremost and rearmost end parts thereof so that setscrews 84 and 85 are inserted through said setscrew insert holes 82 and 83 from the rear side of the deck 22. The setscrews 84 and 85 are rigidly glued to the deck 22 by an adhesive. To fit the cockpit cover 77 to the deck 22 cap nuts 86 and 87 are screwed onto the exposed portion of the setscrews 84 and 85 which have been inserted through the setscrew insert holes 82 and 83 and they are then tightened.

Figure 4:
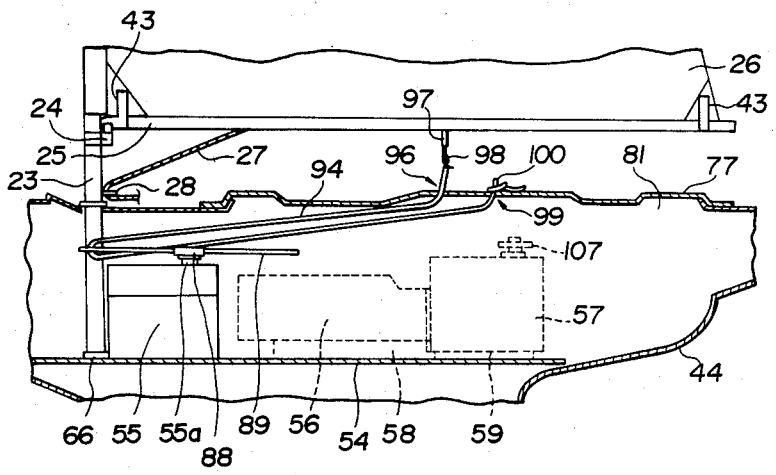
FIG. 4 is a fragmented vertical sectional view of the central part of the hull constituting the radio controlled yacht in accordance with the embodiment of the invention, drawn to an enlarged scale.
Figure 5:
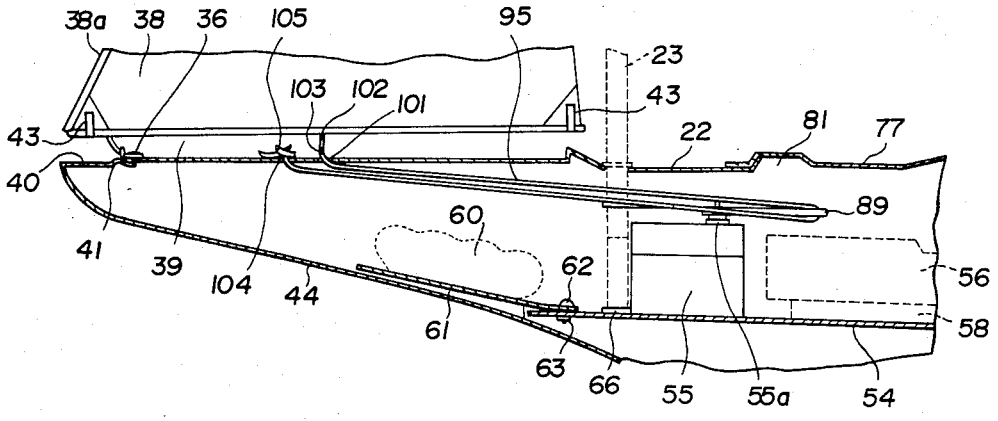
FIG. 5 is a fragmented vertical sectional view of the fore part of the hull constituting the radio controlled yacht in accordance with the embodiment of the invention, drawn to an enlarge scale.
Figure 6:
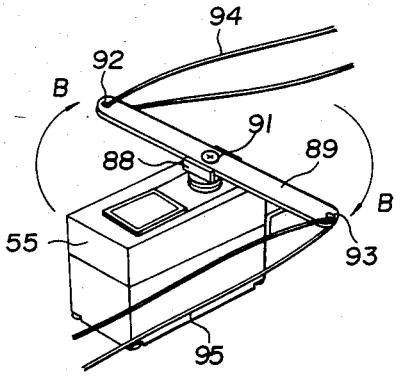
FIG. 6 is a perspective view of a sail servo mounted on the radio controlled yacht in accordance with the embodiment of the invention.

The sail servo 55 has an output shaft $55_a$ to which a sail trimmer 89 is secured via an arm base 88. The sail trimmer 89 is fixed to the output shaft $55_a$ by means of a screw 91 with a washer 90 disposed therebetween. The sail trimmer 89 is formed with sheet insert holes 92 and 93 at both the ends thereof. The one sheet insert hole 92 is adapted to have a main sheet 94 extended therethrough, while the other sheet insert hole 93 is adapted to have a jib sheet 95 extended therethrough. One part of the main sheet 94 extends outside through a hole 96 on the cockpit cover 77 and further it projects above the latter to reach the main boom 25 so that it can be connected to the central part thereof with the aid of an eye 97 and a snap 98, whereas the other part of the main sheet 94 extends in the direction of pulling of the main sheet 94 to project above the cockpit cover 77 through a hole 99 formed on the latter so that it is anchored on the cockpit cover 77 with the aid of a knot 100 which is formed at the extreme end part of the main sheet 94. On the other hand, one part of the jib sheet 95 extends outside through a hole 101 on the deck 22 and further it projects above the latter to reach the jib boom 39 so that it is connected to the central part thereof with the aid of an eye 102 and a snap 103, whereas the other part of the jib sheet 95 extends in the direction of pulling of the jib sheet 95 to project above the deck 22 through a hole 104 formed on the latter so that it is anchored on the deck 22 with the aid of a knot 105 which is formed at the extreme end part of the jib sheet 95. It should be noted that the length of each of the main boom 94 and the jib boom 95 is determined such that both the main boom 94 and the jib boom 95 are located on the central line of the deck 22 when the sail trimmer 89 is oriented in the longitudinal direction of the hull 44 as illustrated in FIGS. 4 and 5.

Next, the rudder servo 75 has an output shaft $57_a$ to which a servo arm 107 is secured via an arm base 106. The servo arm 107 is fixed to the output shaft $57_a$ by means of a screw 109 with a washer 108 disposed therebetween. The servo arm 107 is formed with a hole 110 at the one end part thereof through which the one bent end part of a linkage 112 is inserted and the other bent end part of said linkage 112 is inserted through a hole 111 which is formed at the one end part of the rudder horn 51 whereby the rudder horn 51 is operatively connected to the servo arm 107 so that the former is actuated by the latter.

Figure 9:
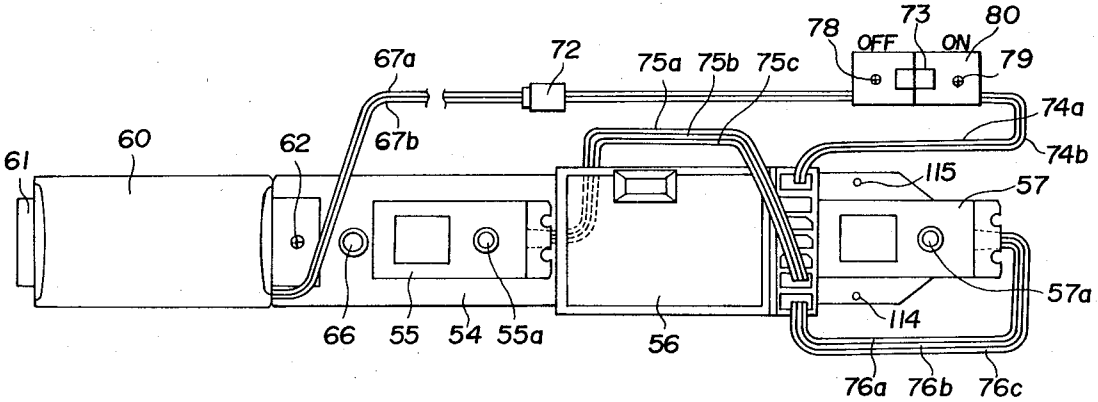
FIG. 9 is a plan view of the control unit in FIG. 8.

Incidentally, in the drawing reference numeral 113 designates a mast insert hole formed on the deck 22. The mast 23 is first inserted through the mast insert hole 113 and its lowermost end part abuts against the mast step 66 on the R/C mount 54 so that the mast 23 is vertically supported on the latter. In FIG. 9 reference numerals 114 and 115 designate a setscrew insert hole respectively through which setscrews are inserted so as to mount the R/C mount 54 on the hull 44.

Next, operation of the radio controlled yacht as constructed in the above described manner will be described below.

First, the switch 73 is shifted to the ON side and thereby the receiver 56 becomes activated by power supply from the rechargeable type battery 60 so that it is ready to receive signals. On the other hand, a switch on a sender (not shown) is also shifted to the ON side and a stick lever on the sender is then set to the base position. The base position relative to the stick lever for the sail servo 55 refers to a position where the sail trimmer 89 assumes the orientation as illustrated in FIGS. 4 and 5 and thereby the main sheet 94 and the jib sheet 95 are brought into the interior of the hull 44 to the ultimate extent. On the other hand, the base position relative to the stick lever for the rudder servo 57 refers to a position where the servo arm 107 is oriented in the direction which forms a right angle relative to the center line 116 of the hull 44 and the rudder 48 is oriented in the direction of the center line 116.

Figure 3:
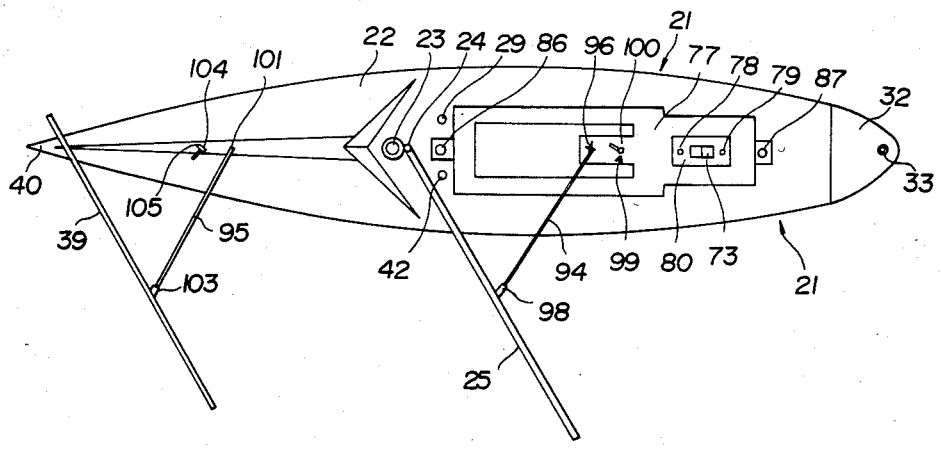
FIG. 3 is a plan view of the radio controlled yacht in FIG. 2.
Figure 7:
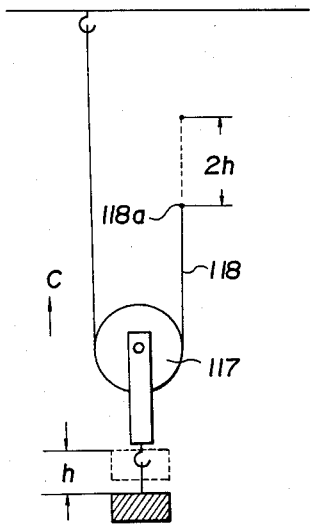
FIG. 7 is a schematic front view of a fall block illustrating the principle of operation of the sail trimmer mounted on the radio controlled yacht in accordance with the invention.
Figure 8:
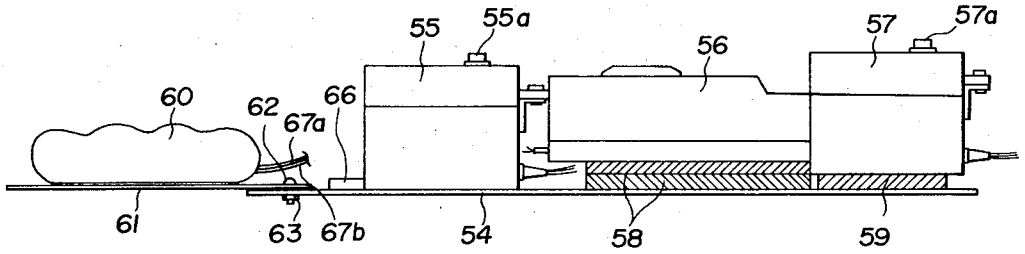
FIG. 8 is a side view of a control unit mounted on the radio controlled yacht in accordance with the invention, drawn to an enlarged scale.

While the above-described positional relation is maintained, the radio controlled yacht 21 is placed on the water to float thereon and then initiates its sailing. Assuming that wind blows from the starboard side of the radio controlled yacht 21, the main sail 26 and the jib sail 38 tend to turn clockwise as seen in FIG. 3 under the influence of wind pressure. At this moment the stick lever on the sender for actuating the sail servo 55 is operated and thereby the sail trimmer 89 is caused to swing in the direction identified by arrow marks B in FIG. 6 by an angular distance corresponding to the displacement of the stick lever. Thus, the main sheet 94 and the jib sheet 95 are drawn out of the holes 96 and 104 under the influence of the swinging force of the main sail 26 and the jib sail 38. As a result, the main sail 26 and the jib sail 38 are caused to turn clockwise as seen in the drawing by an angular distance corresponding to the rotational displacement of the sail trimmer 89 in the direction B. During the pulling movement of the main sheet 94 and the jib sheet 95 the sheet insert holes 92 and 93 on the sail trimmer 89 function in the same manner as a fall block 117 as illustrated in FIG. 7. Specifically, when the fall block 117 is displaced by a distance h in the direction C in the drawing, the extreme end $118_a$ of the rope 118 is caused to move by a distance of 2h in the same direction. Thus, the amount of lengthening and shortening of the main sheet 94 and the jib sheet 95 is increased in comparison with the rotational displacement of the sail trimmer 89 in accordance with the principle described above. Thus, the main sheet 94 and the jib sheet 38 can assume any position located within the range extending from the neutral position to the running position.

Needless to say, the same function is assured as described above, even when wind blows from the port side of the radio controlled yacht 21.

Further, by designing the sail trimmer 89 in such a manner that the distance between the rotation center of the sail trimmer 89 and the sheet insert hole 92 is different from that between the former and the sheet insert hole 93 or by making preliminary adjustment with respect to the length of the main sheet 94 and the jib sheet 95, it is possible to determine as required the angle formed between the main sail 26 and the jib sail 38 during sailing.

On the other hand, when the turning angle of the rudder 48 is controlled, the stick lever on the sender for actuating the rudder servo 57 is operated so as to turn the servo arm 107. Turning force of the servo arm 107 is then transmitted to the rudder horn 51 by way of the linkage 112 so that the rudder 48 is caused to turn together with the rudder horn 51.

When the rechargeable type battery 60 is to be charged, a pair of alligator-shaped clips (not shown) are engaged to the sheet stoppers 29 and 86. There is no necessity for disconnecting the R/C mount 54 from the hull 44 for the purpose of carrying out charging operation. In this connection it should be noted that the switch 73 is shifted to the OFF position during charging. Once the cockpit cover 77 is removed, controlling devices such as sail servo 55 and others can be easily taken out of the hull 44 through the opening 81 together with the R/C mount 54. Therefore, maintenance operations for the control devices is very easily carried out.

In the above-described embodiment an arrangement is made such that the main sail 26 and the jib sail 38 are controlled by means of a single sail servo 55 and therefore it is impossible to carry out actuation of the main sail 26 and the jib sail 38 separately. Further, in the above-described embodiment, description has been made with respect to a sloop style yacht including a main sail and a jib sail but it should of course be understood that the present invention may be applied to a yacht including a single sail.

As described above, a radio controlled yacht is constructed in accordance with the present invention such that the same servo motor as the rudder servo is employable as a sail servo and therefore there is no necessity for mounting a specific power supply source for the sail servo. Thus, a radio controlled yacht can be designed in smaller dimensions and with a lighter weight, and moreover it can be built in the form of a replica dimensioned in an exactly reduced scale relative to a real yacht. Owing to the arrangement made in that way it has the beautiful appearance inherent to yachts and moreover it is easy to be operated.

As long as a pair of charging terminals for a rechargeable type battery are engaged to associated sheet stoppers projected above the deck, there is no necessity for diconnecting the rechargeable type battery from the hull for the purpose of a charging operation. Accordingly, a charging operation is very easily achieved.

Next, a sail for the radio controlled yacht of the invention will be described below with reference to FIGS. 20 to 31 which illustrate an embodiment of the invention.

A main sail body 119 constituting a main sail 26 is made of flexible film of synthetic resin such as high density polyethylene or the like material in a substantially triangular configuration. The main sail body 119 includes a luff 122 which extends between a peak 120 and a tack 121, said luff having a convex configuration of which the top 123 is located at a position having a height of one third of the whole height of luff 122 as measured from the tack 121. Further, the main sail body 119 includes a leech 124 of which the configuration is determined as required and therefore the foot 125 of the sail has a length which is dependant on the configuration of the leech 124.

Figure 21:
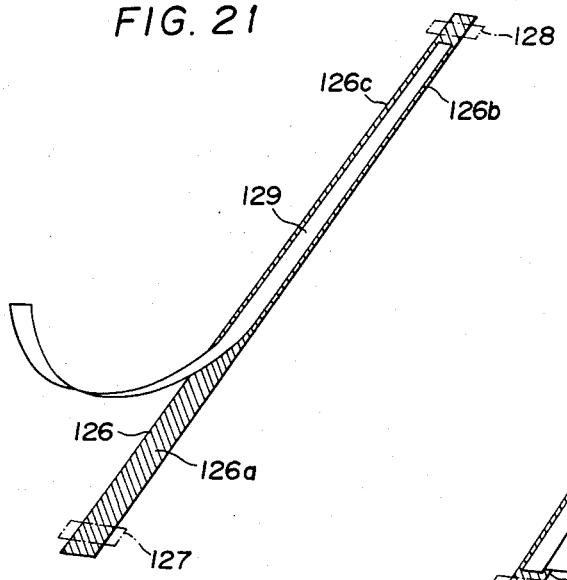
FIG. 21 is a perspective view illustrating how a non-adhesive tape is adhesively placed on an adhesive tape so as to form a non-adhesive area.

Next, a waterproof adhesive tape 126 is immovably placed on a horizontal plane with the aid of two short pieces of adhesive tape 127 and 128 of which both surfaces are coated with adhesive agent, as illustrated in FIG. 21. A sleeve tape 129 made of a film of synthetic resin is then adhesively placed on the central part of the adhesive surface $126_a$ of the adhesive tape 126. The sleeve tape 129 extends linearly in the longitudinal direction of the adhesive tape 126 to form a non-adhesive area on the adhesive surface $126_a$ of the adhesive tape 126.

Figure 22:
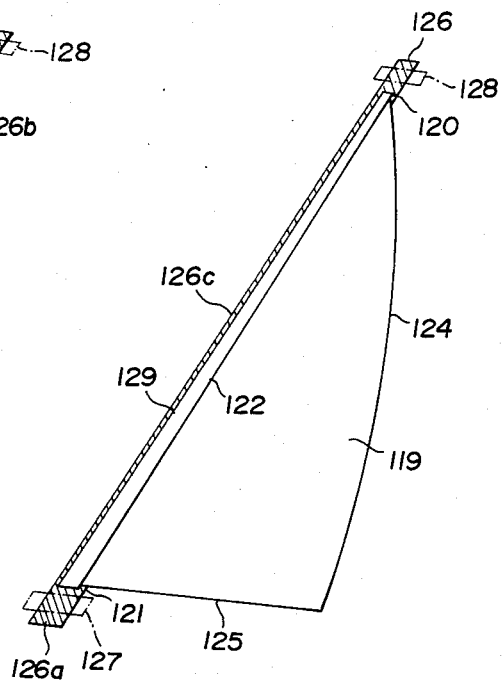
FIG. 22 is a perspective view illustrating that the luff of the main sail body is adhesively stuck to the adhesive tape.
Figure 23:
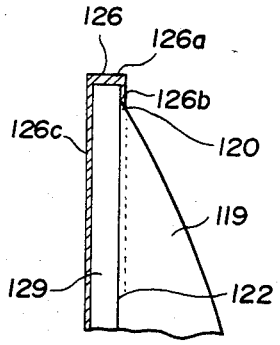
FIG. 23 is a fragmented plan view of the peak portion constituting the main sail body, drawn to an enlarged scale.

As illustrated in FIGS. 22 and 23, the one surface of the luff 122 constituting the main sail body 119 is adhesively stuck onto the adhesive surface $126_b$ extending along the righthand edge of the sleeve tape 129 as seen in the drawings. During the sticking operation, care should be taken so as to assure that the luff 122 extends linearly in parallel to the sleeve tape 129 without any clearance formed therebetween.

Figure 24:
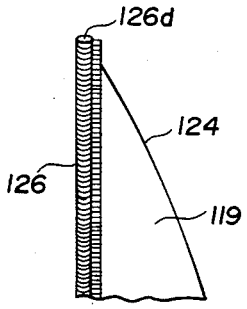
FIG. 24 is a fragmented perspective view illustrating that the adhesive tape in FIG. 23 is formed into the cylindrical configuration.

After completion of the sticking of the luff 122, the adhesive tape 126 is bent into a cylindrical configuration while the sleeve tape 129 is located inside the cylindrical configuration so that the adhesive surface $126_c$ located opposite to the adhesive surface $126_b$ relative to the sleeve tape 129 is adhesively stuck to the other surface of the luff 122 (see FIG. 24). Since the inner surface of the cylindrical hole $126_d$ formed by the adhesive tape 126 is completely lined with the sleeve tape 129, the mast 23 can be inserted through the cylindrical hole $126_d$.

Figure 25:
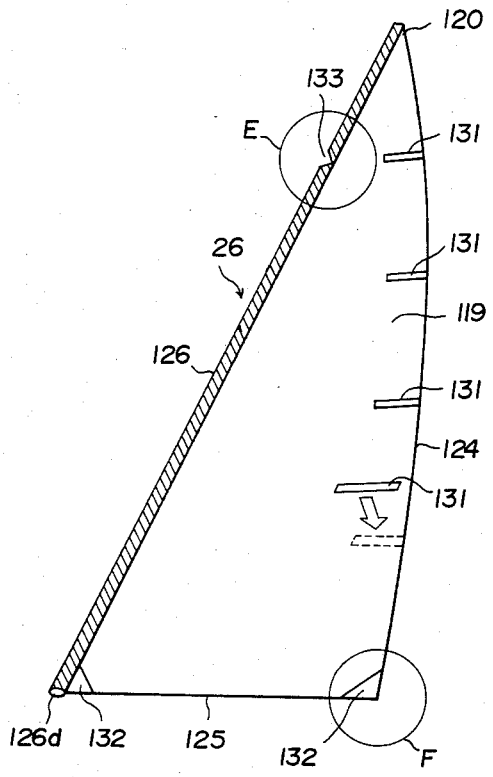
FIG. 25 is a perspective view of the finished main sail.
Figure 26:
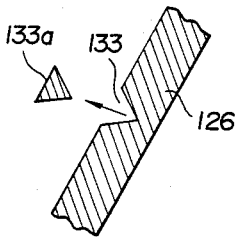
FIG. 26 is an enlarged plan view illustrating the section E in FIG. 25.
Figure 27:
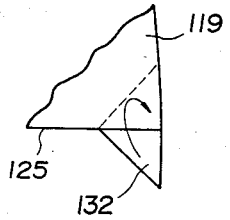
FIG. 27 is an enlarged plan view illustrating the section F in FIG. 25.
Figure 28:
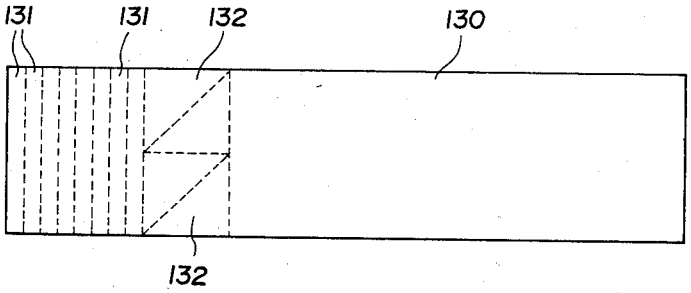
FIG. 28 is a plan view of an adhesive tape in use for reinforcement.
Figure 29:
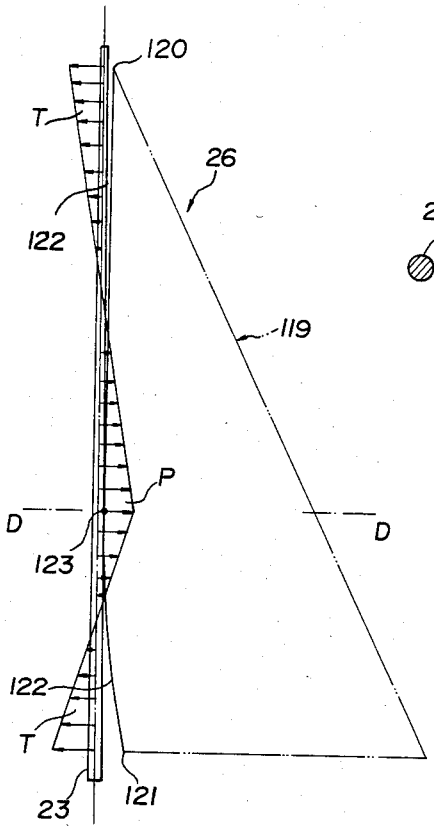
FIG. 29 is a schematic view of the main sail illustrating how tension force and compression force are exerted on the main sail body.
Figure 30:
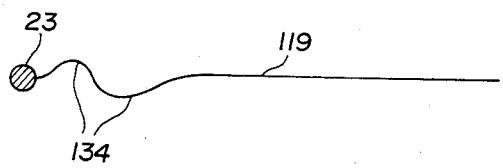
FIG. 30 is a cross-sectional view of the main sail taken along line D—D in FIG. 29.

Battens 131 and triangular reinforcement 132 are cut off from a reinforcing adhesive tape 130 in such a manner as illustrated in FIG. 28 and thereafter the battens 131 and the triangular reinforcement 132 are adhesively stuck to the main sail body 119 at the predetermined positions located on the latter as illustrated in FIGS. 25 and 27. Then, a wedge $133_a$ is cut off out of the cylindrically formed adhesive tape 126 as illustrated in FIG. 26 so that a fitting recess 133 is formed for an eye (not shown) to which the forestay 36 is to be connected later. Thus, a required main sail 26 is obtained by way of the steps as described above.

Figure 31:
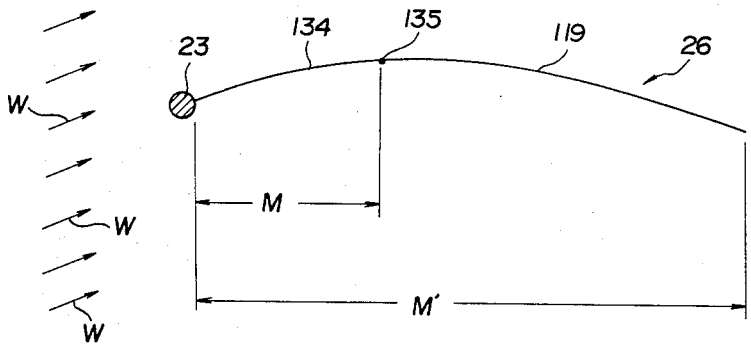
FIG. 31 is a cross-sectional view of the main sail at a time when it is filled with wind.

When the mast 23 is inserted through the cylindrical hole $126_d$ of the thus prepared main sail 26, tension force T appears on both the upper and lower end parts of the luff 122 constituting the main sail 119, while compression force P appears at the top 123 of the convex portion of the luff 122. This is attributable to the fact that the luff 122, having a convex configuration, tends to become linear along the mast 23 inserted through the cylindrical hole $126_d$. As a result a loosened portion 134 is developed along the mast 23 at the position located in the proximity of the latter. The length M of the loosened portion 134 is adjustably determined in dependence on the length of the luff 122 and the curvature of the same and it is preferable for it to be about one third of the length M' of the main sail body 119 as illustrated in FIG. 31. Once the loosened portion 134 is provided on the main sail body 119, a belly (or a pocket) 135 is formed at the end part of the loosened portion 134 when the sail 26 is filled with wind W whereby the main sail body 119 assumes a curved cross-sectional configuration similar to an aerofoil as illustrated in FIG. 31.

As described above, a sail employable for the radio controlled yacht of the invention is constructed such that the main sail body is made of a flexible film of synthetic resin, resulting in substantially reduced weight of the sail being assured.

Since the main sail body is made merely by way of the step of cutting a sheet of synthetic resin film to the predetermined configuration, production of the main sail body is carried out very easily.

Further, since the sail for the radio controlled yacht of the invention is constructed such that it has a curved cross-sectional configuration similar to an aerofoil when it is filled with wind, high propulsive force is generated as wind blows while it assumes an appearance very similar to that of a real yacht during sailing.

Although the illustrated embodiment of the invention has been described merely with respect to the main sail, it should of course be understood that it should not be limited only to this, but it may be applied to the jib sail 38 so as to assure reduced weight and easy production of the same by using synthetic resin film as a main material.

What is claimed is:

1. In a radio controlled yacht of the type including a hull having an interior and an exterior, a sail having a sheet attached thereto for controlling the placement of said sail relative to the centerline of said yacht, a control unit which comprises a receiver, a sail servo having a rotatable output shaft, a rudder servo and a battery so that lengthening and shortening of said sheet attached to said sail are controlled by means of said sail servo and the turning angle of a rudder is controlled by means of said rudder servo, the improvement comprising an eyelet fastened to said yacht near said centerlines, a sail trimmer arm fixedly secured to said output shaft so that said trimmer arm rotates under control of said sail servo, said sail trimmer arm being formed with a sheet insert hole at one end, said sheet extending from said sail through said eyelet, through said sheet insert hole and being anchored at a predetermined position located on the yacht.

2. A radio controlled yacht as defined in claim 1, wherein said yacht includes a main sail having a main sheet for controlling placement of said main sail and a jib sail having a jib sheet for controlling placement of said jib sail, and said sail trimmer arm is attached to sail sail servo at the center of said arm and said arm is formed with sheet insert holes at both ends thereof, one end of said main sheet extending through one of the sheet insert holes on the sail trimmer and being attached to said main sail and the other end of said main sheet being anchored at a predetermined position on the deck, one end of said jib sheet extending through the other sheet insert hole on the sail trimmer and being attached to said jib sail and the other end of the jib sheet being anchored at a predetermined position on the deck of the yacht.

3. A radio controlled yacht as defined in claim 1, wherein the battery, the sail servo, the receiver and the rudder servo are arranged on a mount one after another along the longitudinal direction of said hull, said mount being detachably mounted on the interior of the hull.

4. A radio controlled yacht as defined in claim 1, wherein the hull is integrally molded of synthetic resin in accordance with a conventional injection molding porcess.

5. A radio controlled yacht as defined in claim 1, wherein a hollow keel is molded integrally with the hull and a piece of ballast is inserted into the hollow space of said keel from above.

6. A radio controlled yacht as defined in claim 1, wherein both the sail servo and the rudder servo are constructed by employing the same type of servo motor.

7. A radio controlled yacht as defined in claim 1, wherein the battery comprises a rechargeable type battery having two charging terminals and said yacht further comprises a deck covering said hull, a pair of sheet stoppers made of electrically conductive material are attached to the deck so as to project above the deck in an electrically isolated relation to each other and means for connecting one of said charging terminals for the rechargeable type battery to each of said sheet stoppers.

8. A radio controlled yacht as defined in claim 1, wherein the sail servo, the receiver and the rudder servo are arranged on a mount one after another along the longitudinal direction of the hull of the yacht, said mount being detachably mounted on the interior of the hull, and the yacht further comprises a battery mount adjustably secured to the one end of the mount so that the battery is firmly mounted on said battery mount at any required position relative to the hull.

9. A radio controlled yacht as defined in claim 1, wherein the sail servo further includes an arm base fixedly secured to said output shaft and means for securing said sail trimmer arm to said arm base.

10. A radio controlled yacht as defined in claim 1, wherein the sail trimmer arm is fixedly secured to the output shaft of the sail servo at the central part of the arm and the arm is formed with sheet insert holes at both the ends thereof.

11. In a radio controlled model yacht having a sail, a sheet for controlling the placement angle of said sail relative to the centerline of said yacht, said sheet having one end attached to said sail and a free end, and a radio controlled sail servo responsive to radio-transmitted control signals for lengthening and shortening said sheet, the improvement comprising, first means for fixedly attaching said free end of said sheet to said yacht at a first point near said centerline, second means for slidably attaching said sheet to said yacht at a second point near said centerline, so that a loop is created in said sheet between said first and second points, a member slidably attached to said sheet at a third point on said loop between said first and said second points, said member being moveable under control of said sail servo.

12. In a radio controlled yacht further including a hull and a deck covering said hull, the improvement according to claim 11 wherein said second means comprises a hole in said deck.

13. In a radio controlled yacht wherein said sail servo includes a rotatable output shaft, the improvement according to claim 11 wherein said member comprises a sail trimmer arm attached to said output shaft so that said arm can be rotated in accordance with said radio-transmitted signals.

14. In a radio controlled yacht, the improvement according to claim 13 wherein said trimmer arm has a hole at one end located distally from said shaft, said sheet passing through said hole.

15. In a radio controlled yacht, the improvement according to claim 13 wherein said trimmer arm is attached to said shaft at the center of the arm and said arm has a hole at one end located distally from said shaft, said sheet passing through said hole.

* * * * *